United States Patent [19]

Pirotta

[11] Patent Number: 4,850,181

[45] Date of Patent: Jul. 25, 1989

[54] SAFETY CRUPPER

[75] Inventor: Angelo Pirotta, Milan, Italy

[73] Assignee: Racing Tack Srl, Milan, Italy

[21] Appl. No.: 50,744

[22] Filed: May 15, 1987

[30] Foreign Application Priority Data

May 16, 1986 [IT] Italy ..... 21854/86[U]

[51] Int. Cl.[4] ..... B68B 5/04

[52] U.S. Cl. ..... 54/22

[58] Field of Search ..... 54/22, 78

[56] References Cited

U.S. PATENT DOCUMENTS

| | | | |
|---|---|---|---|
| 199,561 | 1/1878 | McCollum | 54/22 |
| 350,216 | 10/1886 | Stanley | 54/22 |
| 486,537 | 11/1892 | Palmer | 54/22 |
| 899,576 | 9/1908 | Varnum | 54/22 |
| 3,302,371 | 2/1967 | Beach | 54/22 |
| 3,408,791 | 11/1968 | Creef, Jr. | 54/22 |

*Primary Examiner*—Robert P. Swiatek

*Attorney, Agent, or Firm*—Helfgott & Karas

[57] ABSTRACT

A safety crupper comprises a brace connected with a tail hanger formed by a moulded elastomer stiffened by a support skeleton or backbone consisting of a metallic wire. The latter forms a closed loop at a junction of its ends by a deformable sleeve which has a controlled distortion strength.

6 Claims, 1 Drawing Sheet

SAFETY CRUPPER

BACKGROUND OF THE INVENTION

The present invention relates to a safety crupper having specifical safety and resilience features and being particularly suitable as a part of harness used in trot and amble races.

The specifical horse races, called trot and amble, need particular harness helping the animal in maintaining the race, allowing it to keep the body conformed according to the right and required posture.

Specifically the harness part called a crupper prevents the horse from arching its back excessively.

The crupper consists substantially of a brace connected at a first end with the remaining parts of the harness and terminating at the other end with a kind of a semi-rigid hanger or loop in which the horse tail is slipped and which stops against the tail root.

The hanger must be just semi-rigid, because it must bend to follow the shape of the horse croup, but cannot be collapsible to avoid an excessive pressing about the tail root.

Till now the known cruppers have been completely made of leather, because leather shows semi-rigid features almost ideal for the purpose of the crupper.

However, the use of leather, specifically for the hanger engaging the tail, requires a complex manufacturing of many pieces stitched together, which is time-consuming and requires complex hand working heavily weighing on the cost of the finished article.

SUMMARY OF THE INVENTION

Accordingly, it is an object of the present invention to provide a simplified and inexpensive crupper which consists of a few parts manufactured by a simple and substantially automatized working.

Another object of this invention is to provide a minimal number of seams in the crupper as the seams are potential breaking points of the crupper.

Still another object of this invention is to provide a minimal number of buckle joints because such buckles are not only particularly expensive, but also present potential wounding hazards in case of accidents.

A further object of the present invention is to provide a crupper having a particular pull through, the level of which must, however, be restricted to allow the crupper to break in case of fall, in order to avoid excessive damages to the horse.

These and other objects of the present invention are attained by a crupper comprising a brace, preferably of leather, terminating at a first end thereof with a folded loop having an adjustable length provided, for example, by means of a buckle engageable in suitable holes pierced through the brace, and at the second end with a second folded loop having a fixed length and being engageable in a slot formed in a tang from which depart two legs connected to each other by a thickened arc having rounded cross-section, to form a loop or tail hanger widened at the arc, engaging the tail of the horse. The tail engaging loop consists of a moulded elastomer, internally strengthened by a steel wire having a sufficient cross-section so as to provide such a stiffness to prevent permanent distortion under usual strains due to a trotting horse.

In an embodiment, the steel wire, is a spring steel wire having flexural strength and resilience well suitable for a crupper.

In a further preferred embodiment, the spring steel wire is surface-treated in order to assure the greatest possible adhesion to its surface of the elastomer to prevent rotation and sliding of the elastomer in respect to the wire forming its internal support.

The spring steel support wire may be provided with joining means having graded and controlled yielding, just at the slot, in which is engaged the second end of the brace, in order to assure the crupper break just at the joining means in case of horse fall.

The joining means may be formed by a hollow cylinder of a pressure-deformable material connecting both ends of the steel wire forming the support core of the elastomeric material.

The hollow cylinder may be made of brass and may be engaged with the two ends of the spring steel wire by crimping of the cylinder.

To better understand the feature and advantages of the present invention, reference is made to the following detailed description of the embodiment thereof in connection with the attached drawings.

DETAILED DESCRIPTION OF THE PREFERRED EMBODIMENT

Figure 1:
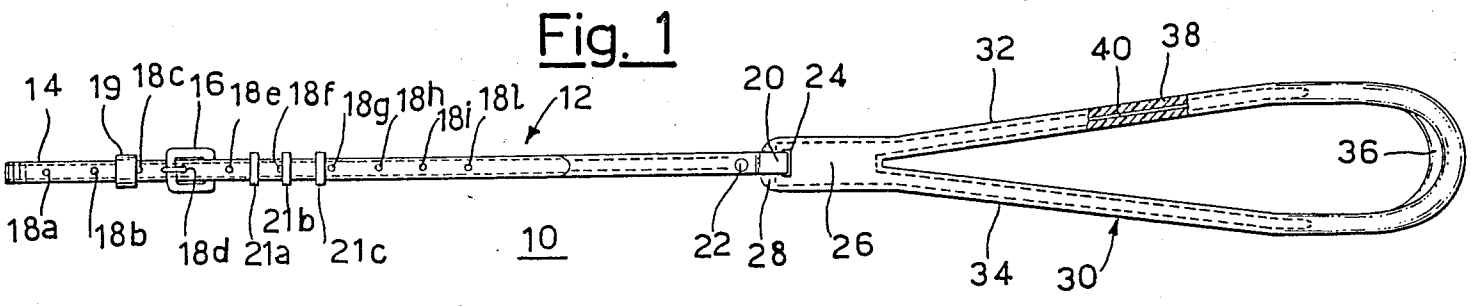
FIG. 1 is a top view, partially broken, of a straightened crupper according to the present invention.
Figure 2:
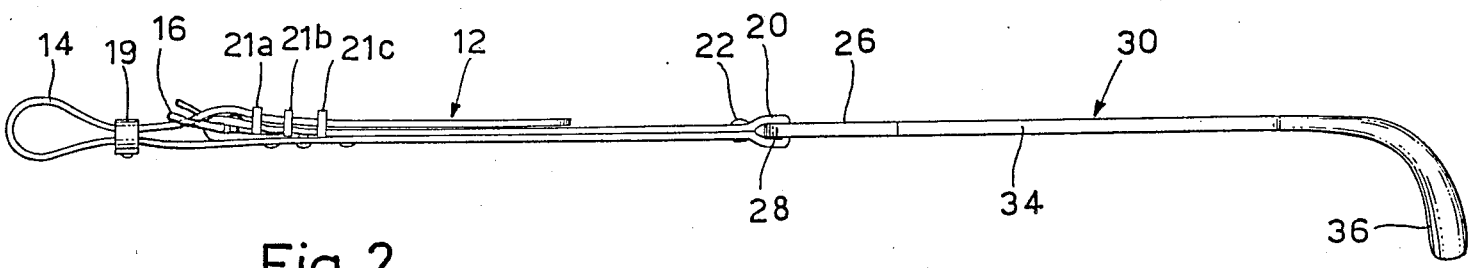
FIG. 2 is a side view of the crupper depicted in FIG. 1.

Referring to the drawings, a crupper 10 is formed by a brace 12, usually made of a leather strip, bent and stitched along the major edges, so that it terminates at the first end in a folded loop 14 threaded in a buckle 16 allowing to control its length by engaging holes 18*a*–18*l* pierced through the leather strip. The loop 14 is helped by small loops 19, 21*a*, 21*a*–21*c*. At the second end opposite to the first end, brace 12 is terminated with a folded loop 20 closed and retained by a rivet knob 22. The folded loop 20 threads through a slot 24 formed in a tang 26 in order to retain a stud 28 integral with tang 26 forming the beginning part of a loop or tail hanger 30. From the tang 26 depart two legs 32 and 34 connected by a thickened arc 36 having a rounded cross-section. The whole tail hanger 30 is formed by a mouldable elastomer 38, for example, of common rubber or silicone rubber, strengthened by a skeleton, core or backbone 40 of metallic wire, specifically of spring steel having undergone a surface treatment ensuring the greatest possible adhesion with the elastomer 38 to prevent separation and sliding of the elastomer in respect to the wire 40.

Figure 3:
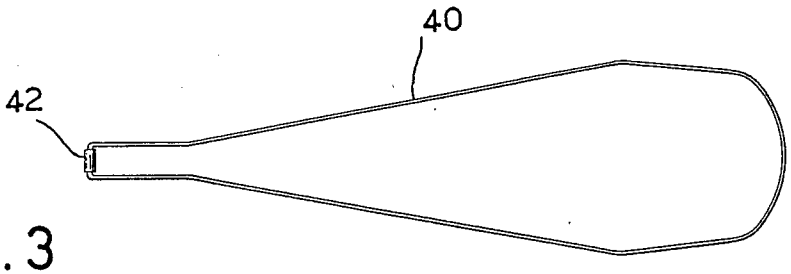
FIG. 3 is a side view of the strengthening steel wire to be embedded in the elastomer during the molding process of the same.

The support wire 40, having the shape indicated in FIG. 3, is formed as a loop closed by connecting the ends thereof by a joining element which specifically can be a hollow cylindrical sleeve 42, into which are inserted the two ends of the wire 40 and which is squeezed, for example, by mechanical crimping, to assure a good pull strength at the junction of the two ends of the wire 40. Specifically, the hollow sleeve 42 may be made of brass to control its pull strength in order to allow the breaking of the junction and thus of the stud 28, containing it, so as to permit the breaking of the tail hanger 30 in case of such serious accidents, as a horse fall.

The present invention permits a faster and more economical manufacture of a crupper which has greater pull strength, less permanent distortion as compared to conventional cruppers and has the possibility of a graded and controlled yielding and breaking in case of the exceptional pulling due to serious accidents.

I claim:

1. A safety crupper adapted for use with horses engaged in trot and amble races, the crupper comprising:

an elongated brace manually adjustable in length, said brace having a first folded loop at a first end and a second folded loop at a second and opposite end;

an elongated tang having a slot at a first end and having a second and opposite end, said second folded loop extending through the slot to secure the second end of the brace to said tang;

first and second elongated legs coplanar with the tang, each leg having a first end and a second end and being secured at the first end thereof to the second end of the tang, the separation between the legs being a minimum at the tang and increasing to a maximum at the two second ends of the legs; and an arc secured at each of two ends thereof to a corresponding one of the legs at the second end thereof, said arc defining a tail hanger for a horse, said tail hanger having a hollow elastomer outer body and a metal wire insert, said wire being provided with joining means having graded and controlled yielding, said joining means being situated at said slot in order to assure that the crupper will break just at the joining means when the crupper is in use and the horse falls.

2. The crupper of claim 1, wherein said arc extends at right angles to said legs and said tang, and said metal wire insert is of steel.

3. The crupper according to claim 2, wherein said wire insert is a spring steel wire.

4. The crupper according to claim 2, wherein said wire insert is surface-treated to prevent rotation and sliding of the outer body with respect to the wire insert.

5. The crupper according to claim 1, wherein said joining means is a hollow cylinder of a pressure deformable material connecting two ends of the wire insert to each other.

6. The crupper according to claim 5, wherein the hollow cylinder is crimped to the two ends of the wire insert.

* * * * *